US007033403B2

(12) United States Patent
Bentham

(10) Patent No.: US 7,033,403 B2
(45) Date of Patent: Apr. 25, 2006

(54) SPRAY DYEING OF GARMENTS

(75) Inventor: Martin Bentham, South Yorkshire (GB)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/601,820

(22) Filed: Jun. 23, 2003

(65) Prior Publication Data

US 2004/0123405 A1 Jul. 1, 2004

Related U.S. Application Data

(63) Continuation of application No. 10/386,161, filed on Mar. 10, 2003, now abandoned, and a continuation-in-part of application No. 10/330,922, filed on Dec. 27, 2002, now Pat. No. 6,835,258.

(51) Int. Cl.
*D06P 5/00* (2006.01)

(52) U.S. Cl. ..... 8/499; 8/924; 8/933

(58) Field of Classification Search ..... 8/499, 8/924, 928
See application file for complete search history.

(56) References Cited

U.S. PATENT DOCUMENTS

| | | | | |
|---|---|---|---|---|
| 2,915,230 | A * | 12/1959 | Brewin et al. | 223/76 |
| 2,974,838 | A | 3/1961 | Parham | 223/76 |
| 2,985,502 | A * | 5/1961 | Kronsbein et al. | 8/150 |
| 2,990,087 | A * | 6/1961 | Brewin et al. | 223/76 |
| 2,990,088 | A * | 6/1961 | Isken et al. | 223/76 |
| 3,022,926 | A * | 2/1962 | Bailey, Jr. | 223/76 |
| 3,181,749 | A * | 5/1965 | Helliwell et al. | 233/76 |
| 4,659,333 | A * | 4/1987 | Schaub | 8/476 |
| 4,786,721 | A | 11/1988 | Tzikas et al. | 534/617 |
| 5,016,308 | A | 5/1991 | McBride et al. | 8/149 |
| 5,205,305 | A | 4/1993 | Yamakita | 505/1 |
| 5,458,265 | A * | 10/1995 | Hester et al. | 223/72 |
| 5,593,072 | A * | 1/1997 | Hester et al. | 223/120 |
| 5,713,223 | A | 2/1998 | Lin | 68/177 |
| 5,964,407 | A | 10/1999 | Sanddkleiva | 239/112 |
| 6,120,560 | A * | 9/2000 | Miller et al. | 8/483 |
| 6,443,569 | B1 | 9/2002 | Mheidle et al. | 347/100 |
| 2002/0138922 | A1 | 10/2002 | Schmiedl et al. | 8/543 |

FOREIGN PATENT DOCUMENTS

| | | |
|---|---|---|
| EP | 1 233 098 A1 | 8/2002 |
| IT | PD2001A000089 | 4/2001 |

OTHER PUBLICATIONS

Milliken & Company; http://www.millikencarpet.com/Millitron.html; "Milliken Millitron Injection Dye Technology;" 1998.

* cited by examiner

*Primary Examiner*—Margaret Einsmann
(74) *Attorney, Agent, or Firm*—Ohlandt, Greeley, Ruggiero & Perle, L.L.P.

(57) ABSTRACT

A method of dyeing a fabric is provided. The method includes removing folds from the fabric, spraying a dye on a first side of the fabric, and exposing the fabric to a migration and fixation process prior to the dye drying on the first side so that the dye migrates from the first side to a second side of the fabric and reacts with and affixes to a component of the fabric.

8 Claims, 3 Drawing Sheets

| Test No. | Application Parameters | | | | | Gun-Target | Dye Concentrate | Thickener | Wetting Agent | Acid regulator | Steam Hood | Autoclave |
|---|---|---|---|---|---|---|---|---|---|---|---|---|
| | Fan Air | Atom Air | Fluid flow rate | Robot speed | Overlap | | | | | | | |
| | Bar | Bar | cc/min | mm/sec | % | mm | g/l | % | g/l | g/l | min | min |
| 1 | 1.5 | 2 | 1000 | 600 | 50 | 150 | 5 | 0 | 6 | 2 | 0 | 5 |
| 2 | 1.5 | 2 | 1000 | 600 | 50 | 150 | 5 | 0 | 6 | 2 | 5 | 0 |
| 3 | 1.5 | 2 | 1000 | 600 | 50 | 150 | 5 | 0 | 6 | 2 | 1 | 5 |
| 4 | 1.5 | 2 | 1000 | 600 | 50 | 150 | 5 | 0 | 6 | 2 | 1 | 0 |
| 5 | 1.5 | 2 | 1000 | 600 | 50 | 150 | 10 | 0 | 6 | 2 | 0 | 5 |
| 6 | 1.5 | 2 | 1000 | 600 | 50 | 150 | 10 | 0 | 6 | 2 | 5 | 0 |
| 7 | 1.5 | 2 | 1000 | 600 | 50 | 150 | 20 | 0 | 6 | 2 | 0 | 5 |
| 8 | 1.5 | 2 | 1000 | 600 | 50 | 150 | 20 | 0 | 6 | 2 | 5 | 0 |
| 9 | 1.5 | 2 | 1000 | 600 | 50 | 150 | 20 | 0 | 6 | 2 | 5 | 0 |
| 10 | 1.5 | 2 | 1000 | 600 | 50 | 150 | 20 | 0 | 6 | 2 | 10 | 5 |
| | | | | | | | | | | | | |
| 11 | 1.5 | 2 | 800 | 600 | 50 | 150 | 10 | 0 | 6 | 2 | 0 | 5 |
| 12 | 1.5 | 2 | 800 | 600 | 50 | 150 | 10 | 0 | 6 | 2 | 5 | 0 |
| 13 | 1.5 | 2 | 800 | 600 | 50 | 150 | 20 | 0 | 6 | 2 | 0 | 5 |
| 14 | 1.5 | 2 | 800 | 600 | 50 | 150 | 20 | 0 | 6 | 2 | 5 | 0 |
| | | | | | | | | | | | | |
| 15 | 1.5 | 2 | 600 | 600 | 50 | 150 | 20 | 0 | 6 | 2 | 0 | 1 |
| 16 | 1.5 | 2 | 600 | 600 | 50 | 150 | 20 | 0 | 6 | 2 | 0 | 5 |
| 17 | 1.5 | 2 | 600 | 600 | 50 | 150 | 20 | 0 | 6 | 2 | 5 | 0 |
| 18 | 1.5 | 2 | 600 | 600 | 50 | 150 | 20 | 0 | 6 | 2 | 10 | 0 |
| 19 | 1.5 | 2 | 600 | 600 | 50 | 150 | 20 | 0 | 6 | 2 | 0 | 0 |

30 32

Fig. 3

SPRAY DYEING OF GARMENTS

CROSS REFERENCE TO RELATED APPLICATIONS

This application is a continuation of U.S. application Ser. No. 10/386,161 entitled "SPRAY DYEING OF GARMENTS" filed on Mar. 10, 2003 now abandoned, the contents of which are incorporated by reference herein. This application is also a continuation-in-part of U.S. application Ser. No. 10/330,922 entitled "Automated Process for the Production of Garments" filed on Dec. 27, 2002 now U.S. Pat. No. 6,835,258, the contents of which are incorporated by reference herein.

BACKGROUND OF THE INVENTION

1. Field of the Invention

The present invention is related to fabric dyeing. More particularly, the present invention is related to methods of spray dyeing garments.

2. Description of Related Art

Today, fabrics are made from a wide-variety of natural fibers, synthetic fibers, and any combination thereof. Many methods have been proposed for dyeing fabrics.

One method, commonly referred to as yarn dyeing, involves dyeing individual fibers or yarns prior to these fibers being sewn or knitted into a fabric. One problem associated with such yarn dyeing method relates to inventory control of the yarns and associated garments. For example, yarn dyeing requires the garment manufacturer to maintain a supply of the various colored yarns used in its products. This can lead to an increased cost of goods.

Another dyeing method is commonly referred to as bulk dyeing. In bulk dyeing, un-dyed fibers or yarns are knitted or woven into a raw or un-dyed fabric. The raw fabric is subsequently dyed. The dyed fabric is then used to make the desired product, such as a garment.

Some common bulk dyeing methods include vat dyeing, beam dyeing, jet dyeing, and bath dyeing. Vat dyeing typically consists of immersing a piece of fabric in a vat of liquid dye. Beam dyeing involves winding a length of fabric about a perforated beam. The beam is then placed in a vessel where liquid dye is pumped into the center of the beam, out of the perforations, and through the fabric. Jet dyeing involves placing the fabric in a high-pressure, high-temperature kettle of liquid dye. Bath dyeing involves immersing the fabric in a bath of dye, which is contained in a rotating drum.

One problem associated with bulk dyeing methods relates to the fabric that is cut away or removed during manufacture of the fabric into the desired garment. Here, the fabric that is cut away has been dyed and, thus, includes the cost of the dye. This can lead to an increased cost of goods for garments made from bulk dyed fabrics. Another problem with bulk dyeing methods relates to the large amounts of water required during processing, which can increase cost of goods for such bulk dyed fabrics.

Yet another problem with bulk dyed fabrics in the manufacture of garments is related to the unpredictability of consumer color preferences. In the garment industry, change in the consumer's preference for one color over another color can lead to an overstock of the undesired colored garments and a back order situation of the desired colored garments. Thus, garments made from bulk dyed fabrics have not proven flexible enough to meet increasing and changing consumer demands.

Further methods of dyeing fabrics involve printing a dye onto a surface of a fabric. This method is commonly used to apply a decorative pattern on the surface of the fabric. Such printing methods include screen-printing and inkjet printing.

While these methods have proven useful in quickly changing from one decorative pattern to another, they have not proven useful in bulk dyeing of fabrics or in the dyeing of completed garments.

Accordingly, there is a continuing need for flexible, low cost, low waste methods of dyeing fabrics. Further, there is a continuing need for flexible, low cost, low waste methods of dyeing garments made from fabrics.

SUMMARY OF THE INVENTION

It is an object of the present invention to provide methods of spray dyeing fabric.

It is another object of the present invention to provide methods of spray dyeing a garment made of a fabric.

These and other objects and advantages of the present invention are provided by a method that includes removing folds from the fabric, spraying a dye on a first side of the fabric, and exposing the fabric to a migration and fixation process prior to the dye drying on the first side. The migration and fixation process causes the dye to migrate from the first side to a second side and to react with and affix to a component of the fabric.

These and other objects and advantages are also provided by a method including disposing a garment on a carrier, spraying a first side of the garment with a dye, and steaming and heating the garment prior to the dye drying on the first side. The steam and heat cause the dye to migrate from the first side to a second side of the garment and to react with and affix to a component of the fabric.

The above-described and other features and advantages of the present invention will be appreciated and understood by those skilled in the art from the following detailed description, drawings, and appended claims

BRIEF DESCRIPTION OF THE DRAWINGS

FIG. 3 is a table of results of testing of the process of FIG. 2.

DETAILED DESCRIPTION OF THE INVENTION

Figure 1:
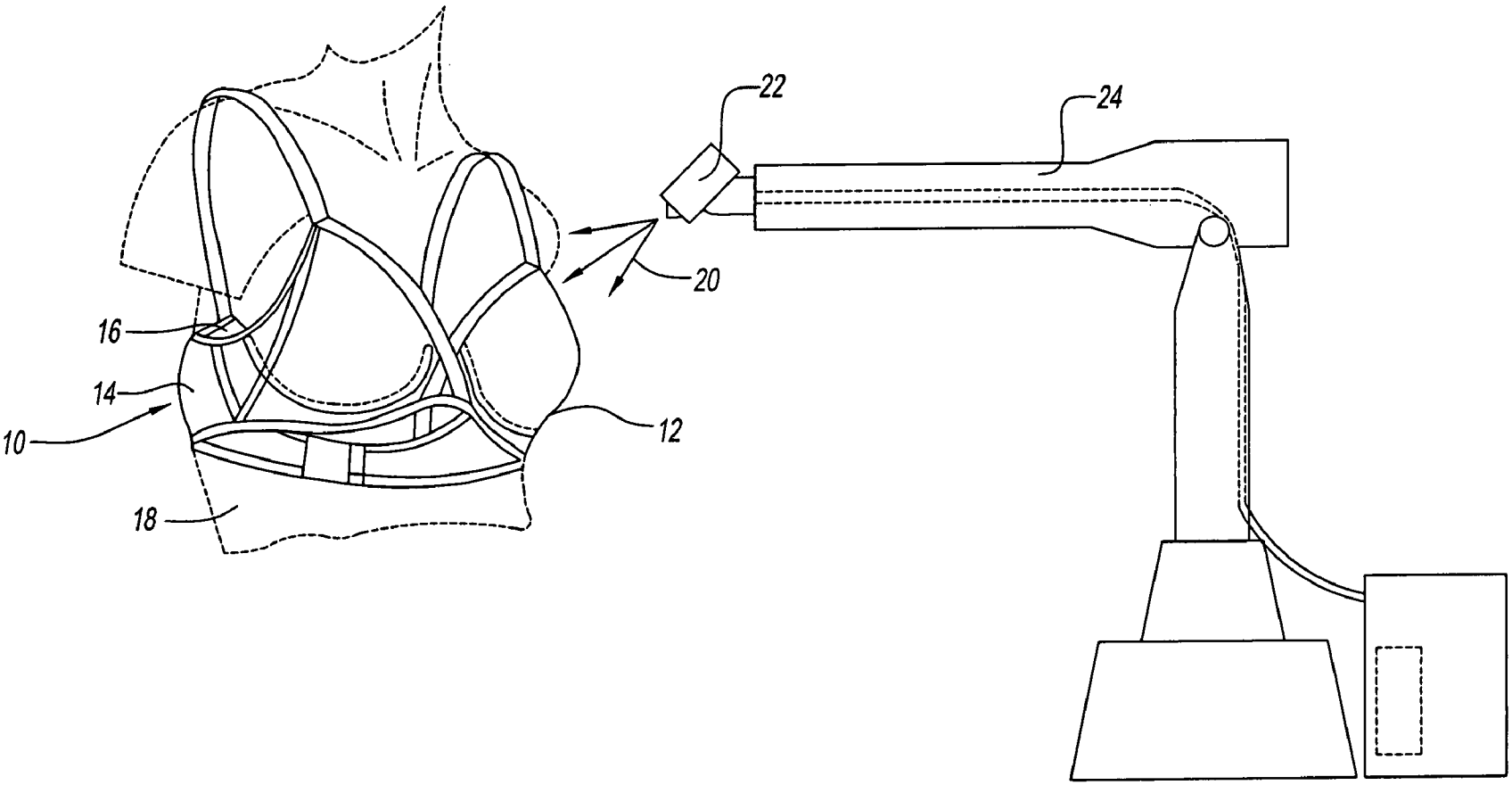
FIG. 1 is a perspective view of a garment undergoing a spray dyeing operation according to the present invention.

Referring to the drawings and in particular to FIG. 1, a garment generally referred to by reference numeral 10 is shown. For purposes of clarity, garment 10 is illustrated as a brassiere. Of course, it is contemplated by the present invention that garment 10 be any garment such as, but not limited to, a shirt, a pair of pants, a pair of underwear, a pair of panties, a sock, a skirt, a dress, a pair of shorts, a coat, a suit, a scarf, a glove, a hat, and other apparel items.

Garment 10 can be made using traditional cut-and-sew methods. Further, and in lieu of sewing, garment 10 can be made using adhesives, thermal bonding, and other joining methods. Alternately, garment 10 can be made using a circular knitting machine such as those available from SANTONI S.p.A. Of course, it is contemplated by the present invention for garment 10 to be made by combinations of any of the above methods.

Garment 10 is made of an un-dyed or raw fabric 12. Garment 10 has a first or exterior side 14 and a second or interior side 16. Garment 10 is positioned on a carrier 18 (illustrated in phantom) so that first side 14 is substantially exposed. Carrier 18 provides shape to garment 10 thereby removing folds and creases from the garment.

In the example where garment 10 is a brassiere, carrier 18 can approximate the upper torso of a wearer. Of course, it is contemplated by the present invention for carrier 18 to have other shapes sufficient to substantially expose (e.g., remove folds and creases) first side 14.

A dye 20 is sprayed on first side 14 of garment 10 using a spray nozzle 22. Preferably, spray nozzle 22 is movable with respect to first side 14 by a robot 24. Robot 24 is controlled to move spray nozzle 22 with respect to first side 14 so that a substantially even coat of dye 20 is applied to the first side of garment 10.

Advantageously, nozzle 22 and robot 24 can apply dye 20 to first side 14 of garment 10 in about one to about twenty seconds, and preferably in about four to about ten seconds. Of course, this time depends on the size of garment 10, where larger garments would be expected to take longer and/or smaller garments would be expected to take shorter than the aforementioned ranges.

The application of coatings, such as paints, using spray nozzle 22 and robot 24 is common in the automotive industry. For example, dye 20 can be sprayed on garment 10 using robotic spraying equipment as described in U.S. Pat. No. 5,964,407 assigned to ABB Flexible Automation, the contents of which are incorporated in their entirety herein by reference.

It should be recognized that the present invention is illustrated in FIG. 1 having one spray nozzle 22 moved by one robot 24. However, it is also contemplated by the present invention to have more than one robot 24 and/or for the robot to have more than one spray nozzle 22. Moreover, it is also contemplated by the present invention for spray nozzle 22 to remain stationary and for carrier 18 to be moved with respect to the spray nozzle. Additionally, it is contemplated for both carrier 18 and nozzle 22 to be movable with respect to one another.

Dye 20 reacts with and affixes to a component of fabric 12. The term "reactive" or "reacts" as used herein shall mean the action of the dye with the fabric that results in the formation of an attachment to the one or more components of the fabric, wherein the attachment can be a covalent bond, an ionic bond, a disbursement into the fiber molecule, and any combination of the foregoing.

For example, fabric 12 can be a polyamide fabric with or without an elastic yarn, including elastane, lycra, nylon, spandex, and combinations thereof. Dye 20 can be a dye as in U.S. Pat. No. 4,786,721, U.S. Patent Application 2002/0138922A1, European Patent Application No. EP 1 275 700, and other dyes.

In a preferred embodiment, fabric 12 is a synthetic polyamide fabric and dye 20 is a water-soluble dye that reacts with and affixes to an amine site of the fabric so that the dye can bind with the fabric. The reaction of dye 20 with the amine sites of fabric 12 affixes the dye to the fabric through the formation of a covalent bond. It has been found that dye 20 provides a degree of fixation to and penetration into the individual fibers of fabric 12. This fixation of dye 20 to fabric 12 is sufficient to allow the dye to be sprayed on only first side 14 of garment 10, while providing acceptable color at second side 16. It has further been determined that spraying of dye 20 of the present invention allows garment 10 to be manufactured in an automated fashion.

Fabric 12 is described above by way of example as a synthetic polyamide fabric. Additionally, dye 20 is described above by way of example reacting with an amine site of the synthetic fabric. However, it is contemplated by the present invention for fabric 12 to be made of any natural fiber, synthetic fiber, and any combination thereof. Similarly, it is contemplated by the present invention for dye 20 to be any fiber-reactive compound. For example, dye 20 can be a dye capable of reacting with and/or chemically bonding to the hydroxyl groups of cellulose fibers, the amino, carboxy, hydroxy and/or thiol groups of wool or silk fibers, and/or the amino groups and/or carboxy groups of synthetic polyamides.

Figure 2:
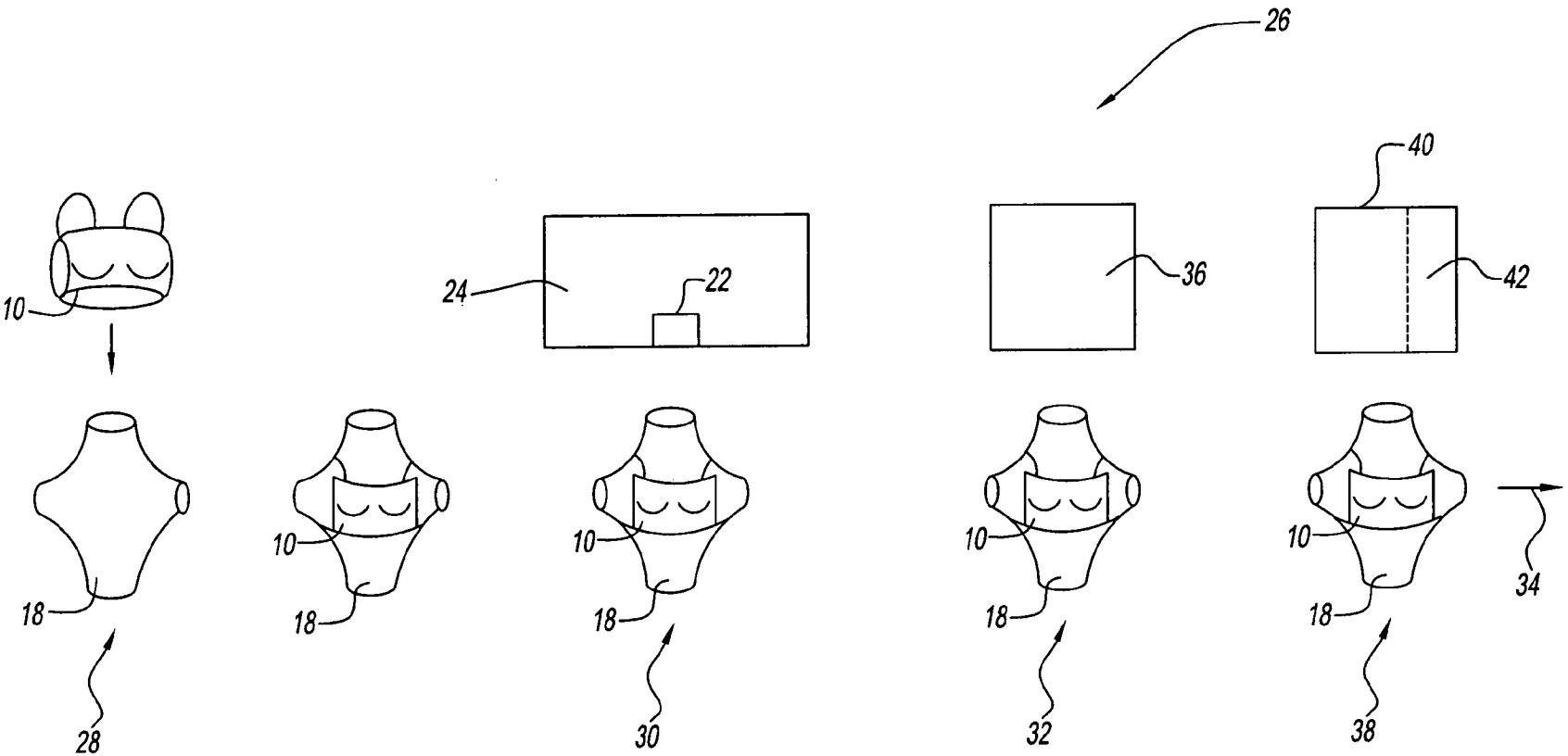
FIG. 2 is a schematic illustration of an automated process of spray dyeing according to the present invention.

An automated process 26 for manufacturing garment 10 is illustrated in FIG. 2. Process 26 has a first station 28, a second station 30, and a third station 32. Carrier 18 is, preferably, movable among the first, second, and third stations 28, 30, 32 in a direction 34. Alternately, it is contemplated for stations 28, 30, 32 to move with respect to carrier 18 in a direction opposite direction 34. Further, it is contemplated for stations 28, 30, 32 and carrier 18 to move with respect to one another.

At first station 28, folds are removed from fabric 12. For example, first station 28 positions garment 10 on carrier 18 so that second side 16 is facing the carrier and first side 14 is facing away from the carrier. In this position, carrier 18 shapes garment 10 or makes the garment taut so that any folds or creases in fabric 12 are substantially removed. Thus, first side 14 is substantially or entirely exposed.

Carrier 18 is exposed to second station 30 where first side 14 is sprayed with dye 20. This is preferably achieved by controlling robot 24 to move nozzle 22 with respect to carrier 18 to spray first side 14 with dye 20. For purposes of clarity, nozzle 22 and robot 24 are illustrated schematically in FIG. 2.

Nozzle 22 and robot 24 can be used to more precisely control the amount of-dye 20 applied to garment 10 than in previous dyeing methods. For example, robot 24 can move nozzle 22 to only apply dye 20 to garment 10, while minimizing over-spray (i.e., spray of dye 20 onto carrier 18). Thus, second station 30 can minimize the use of dye 20 as compared to prior bulk or yarn dyeing methods. In this manner, process 26 optimizes the amount of dye 20 used to manufacture garment 10, which can reduce the cost of the garment.

Before dye 20 dries on first side 14, carrier 18 is exposed to third station 32. Third station 32 spreads dye 20 throughout fabric 12 and affixes the dye to the fabric. For example, third station 32 can apply a desired amount of steam and heat to garment 10. It is believed that the action of steam and heat applied by third station 32 has several benefits to the dyeing of garment 10.

For example, third station 32 can assist in relaxing fabric 12, allowing dye 20 to penetrate between the individual fibers of the fabric and ensuring that the dye migrates from first side 14 to second side 16 (i.e., substantially uniform distribution of dye 20 throughout fabric 12). In addition, third station 32 can assist in allowing dye 20 to penetrate into the individual fibers of fabric 12. Further, third station 32 can be a catalyst to the chemical reaction between dye 20 and the molecular structure (i.e., amine groups) of fabric 12.

Third station 32 can have a steam hood or autoclave 36 that exposes fabric 12 to steam and heat in a manner and amount sufficient to spread dye 20 throughout fabric 12 and affix the dye to the fabric. For example, third station 32 can apply saturated steam, such as steam at a temperature of about 102 degrees Celsius and a relative humidity of about 100 percent. Third station 32 can apply steam to fabric 12 for about 1 to 7 minutes, preferably about 3 to 5 minutes.

It should be recognized that the use of atmospheric steam, pressurized steam and/or superheated steam, and for a period shorter or longer than the aforementioned time range, is also contemplated by the present invention. It is further contemplated by the present invention for any combination of saturated steam, high temperature steam, and dry heat to be utilized at third station 32.

After dye 20 has been spread through and affixed to fabric 12 at third station 32, carrier 18 can be exposed to a fourth station 38. Fourth station 38 can wash off or remove any unfixed dye 20 from fabric 12 and/or carrier 18.

Process 26 advantageously minimizes the amount of dye 20 that is washed off garment 10 by fourth station 38. For example, second station 30 optimizes the amount of dye 20 applied to garment 10. Additionally, the reactive nature of dye 20 used by second station 30 further minimizes the amount of the dye that is applied to garment 10. Accordingly, process 26 can minimize the amount of dye 20 that is washed off by fourth station 38, which can further reduce the cost of the garment as compared to other dyeing methods.

In an exemplary embodiment, fourth station 38 can include a spray head 40 for spraying a cleaning liquid, such as water, on fabric 12. Additionally, fourth station 38 can include a drying portion 42 for removing the cleaning liquid and any residual, un-affixed dye from garment 10. Drying portion 42 can dry garment 10 by way of convection, conduction, pressure, centrifugal forces, and combinations thereof.

Advantageously, process 26 applies, spreads, and affixes dye 20 in fabric 12 in a time effective, efficient manner. Accordingly, the cost of garment 10 can be reduced.

In addition, process 26 allows for rapid changeover from one color to another color. For example, process 26 can make as few as one garment 10 of a first color before changing over to dye the next garment with a second, different color. Thus, process 26 also eliminates the inventory control costs and problems associated with the pre-dyed yarns and pre-dyed garments of prior processes.

Referring now to FIG. 3, various exemplary test parameters of process 26 are illustrated. For example, FIG. 3 illustrates various application parameters of second station 30, and various the migration and fixing parameters of third station 32.

An ECCO 70 AS automatic gun (i.e., spray nozzle 22) was used having a 1.4 mm tip and a T297 aircap. The dye 20 that was used is as described in published U.S. Patent Application 2002/0138922A1. The fabric 12 that was used was made of synthetic polyamide fabric.

Spray nozzle 22 was supplied with fan air of about 1.5 bar and atomized air of about 2 bar. Spray nozzle 22 was positioned about 150 millimeters (mm) from garment 10. In addition, spray nozzle 22 was moved with respect to garment 10 at a speed of about 600 millimeters per second (mm/sec) and with an overlap of spray of about 50%.

The flow rate of dye 20 through spray nozzle 22 was tested at about 600 cubic centimeters per minute (cc/min), 800 cc/min, and about 1000 cc/min. In addition, the concentration of dye 20, the amount of wetting agent added to the dye, and the amount of acid regulator added to the dye were all varied during the tests.

Two different types of third station 32 were tested. For example, a steam hood, an autoclave, and combinations thereof were was as third station 32. The time garment 10 was exposed to third station 32 was also varied between about 5 minutes and about 15 minutes.

In the examples where third station 32 is a steam hood, garment 10 was exposed to atmospheric steam at a temperature of about 100 degrees Celsius and a relative humidity of up to about 100 percent. In the examples where third station 32 is an autoclave, garment 10 was exposed to pressurized steam at a pressure of about 3 bar, a temperature of about 135 degrees Celsius, and a relative humidity of about 35 percent.

The results of tests 1 through 19 are discussed below. The color of garments 10 that resulted from test numbers 1, 5, and 7 (e.g., autoclave) were compared to the results of test numbers 2, 6, and 8 (e.g., steam hood), respectively. It appears that better fixation is achieved with the autoclave than with the steamer. However, it is believed that neither was provided at ideal conditions, which are believed to be about 102 degrees C. and at about 100% relative humidity.

It was determined that increasing the concentration of dye 20 increases the color intensity, but not proportionally by comparing the color of garments 10 that resulted from test numbers 1, 5 and 7. It was also determined that decreasing the dye flow rate through the spraygun has little effect on the color intensity on the outside of the garment by comparing the color of garments 10 that resulted from test numbers 7, 13 and 16. However, penetration to the inside of the garment decreases as the flow rate is decreased, which may be offsetable by optimization of the parameters of third station 32.

The color of garment 10 appeared most acceptable at a flow rate of about 1000 ml/min, with a concentration of dye 20 for a medium shade of about 5 grams per liter, and a pH for fixation of about 3 to 4, achieved by the use of about 2 grams per liter of citric acid. Additionally, it has been found that the presence of a wetting agent at up to about 6 grams per liter is desirable.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that this invention will include all embodiments falling within the scope of the appended claims.

What is claimed is:

1. A method of dyeing a garment made of fabric comprising:

disposing the garment on a carrier;

moving a spray nozzle with respect to the garment so that a substantially even coat of a dye is applied to a first side of the garment; and steaming and heating the garment after said substantially even coat of said dye is applied to said first side but prior to said dye drying on said first side so that said dye migrates from said first side to a second side and reacts with and affixes to a component of the fabric.

2. The method as in claim 1, further comprising moving said spray nozzle with respect to the garment to only apply said dye to the garment while minimizing over-spray of said dye.

3. The method as in claim 1, further comprising washing the garment while disposed on the carrier to remove to any residual, un-affixed dye from the garment after steaming and heating the garment.

4. The method as in claim 1, wherein steaming and heating the garment ensures substantially uniform distribution of said dye throughout the garment.

5. A method of dyeing a garment comprising:

disposing the garment on a carrier;

spraying a dye on a first side of the garment to minimize over-spray of said dye; and exposing the garment to a migration and fixation process prior to said dye drying on said first side but after spraying said dye on said first side to provide a substantially uniform distribution of said dye throughout the garment.

6. A method of dyeing a garment comprising:

disposing the garment on a carrier;

moving a dye applicator and the garment with respect to one another so that a substantially even coat of a dye is applied to a first side of the garment; and steaming and heating the garment after applying said substantially even coat of said dye but before drying said dye so that said dye migrates from said first side to a second side and reacts with and affixes to a component of the garment.

7. The method as in claim 6, wherein said dye applicator comprises a nozzle and robot.

8. The method as in claim 6, wherein said dye has a substantially uniform distribution throughout the garment.

* * * * *